United States Patent [19]

Reinehr et al.

[11] Patent Number: 5,057,260

[45] Date of Patent: Oct. 15, 1991

[54] SPINNING OF SEGMENTED POLYURETHANE-UREA ELASTOMERS IN A STEAM ATMOSPHERE

[75] Inventors: Ulrich Reinehr, Dormagen; Heinz Gall, Goch/Niederrhein; Josef Kulig, Dormagen; Rudi Dauscher, Dormagen; Rolf-Burkhard Hirsch, Dormagen, all of Fed. Rep. of Germany

[73] Assignee: Bayer Aktiengesellschaft, Leverkusen, Fed. Rep. of Germany

[21] Appl. No.: 504,491

[22] Filed: Apr. 4, 1990

[30] Foreign Application Priority Data

Apr. 17, 1989 [DE] Fed. Rep. of Germany ..... 3912510

[51] Int. Cl.[5] ..... D01D 5/04; D01F 6/70

[52] U.S. Cl. ..... 264/205; 264/211.15; 264/211.17

[58] Field of Search ..... 264/210.8, 204, 205, 264/211.14, 211.17, 211.15

[56] References Cited

U.S. PATENT DOCUMENTS

| | | | |
|---|---|---|---|
| 3,053,611 | 9/1962 | Griehl | 264/210.8 |
| 3,094,374 | 6/1963 | Smith | 18/54 |
| 3,184,426 | 5/1965 | Thoma et al. | 260/30.8 |
| 3,428,711 | 2/1969 | Hunt | 260/859 |

FOREIGN PATENT DOCUMENTS

| | | |
|---|---|---|
| 1669412 | 2/1971 | Fed. Rep. of Germany . |
| 44-896 | 1/1969 | Japan . |
| 1159623 | 7/1969 | United Kingdom . |

OTHER PUBLICATIONS

Database WPI, accession No. 68-23684q [00], Derwent Publications Ltd., London, GB.

JP-B-44 000 896 (Kurashiki Rayon Co., Ltd.), 16-0-1-1969.

*Primary Examiner*—Hubert C. Lorin

*Attorney, Agent, or Firm*—Sprung Horn Kramer & Woods

[57] ABSTRACT

An improved dry spinning process for the production of polyurethane elastomer threads using superheated steam as the spinning medium, comprising (1) spinning polyurethane-urea elastomers prepared by chain lengthening of NCO prepolymers with diamine from a solution containing dimethylformamide or dimethylacetamide via a hot spinneret having a nozzle at not less than 100° C. and at a spinning solution temperature in the nozzle of not less than 100° C. into a heated spinning chimney at a chimney wall temperature of not less than 160° C., while (2) introducing superheated steam into the spinning chimney at a temperature above 250° C. as the spinning medium in an amount of at least 20 kg/h, if the chimney diameter is less than or equal to 28 cm, or if the chimney diameter is greater than 28 cm, in an amount of at least 20 kg/h increased by up to a factor H, wherein factor H is equal to the chimney cross-section/615 $cm^2$, (3) feeding the spinning medium and spinning solvent to a recovery step at the end of the spinning chimney, and (4) maintaining a take-off speed of the threads from the chimney of at least 250 m/min. The improved process yields improved thread properties in the resulting filament yarns.

6 Claims, No Drawings

SPINNING OF SEGMENTED POLYURETHANE-UREA ELASTOMERS IN A STEAM ATMOSPHERE

The invention relates to a process for spinning segmented polyurethane-urea elastomers in dry spinning chimneys while passing in certain amounts of superheated steam. The process allows an exceptional increase in the spinning capacity per chimney and an increase in the spinning speed, in . particular at medium and coarse titres, at high spinning chimney temperatures and without an undesirable change in, and in part even with a distinct improvement in the thread properties of the resulting filament yarns. The new process in particular also prevents tendencies of the spinning solvents to decompose at the high temperatures (which are otherwise necessary for substantial removal of the spinning solvent at high spinning speeds) in air, without inert gases having to be employed as spinning air media. The new process moreover renders possible spinning of (multi)filament yarns with relatively high individual filament titres, which contributes towards improving the stability of the filament yarns towards external effects and degradation influences.

Highly elastic PU elastomer threads (Spandex or Elasthan threads) are predominantly produced by wet and in particular dry spinning processes. For this, highly viscous solutions of the elastomers in dimethylformamide or dimethylacetamide are spun through multi-hole nozzles into heated spinning chimneys, into which hot air is additionally fed (c.f. H. Oertel in Synthesefasern (Synthetic Fibres), publisher: B. v. Falkai, Verlag Chemie Weinheim 1981, p. 180 to 190 and H. Gall/K. H. Wolf in Kunststoffhandbuch (Plastics Handbook), vol. 7, Polyurethane (Polyurethanes), 1983, C. Hanser-Verlag, p. 611 to 627).

The temperature of the spinning solution, temperature in the spinning chimney, temperature of the hot air additionally fed in and the take-off speed, as well as the geometric dimensions of the spinning chimneys essentially determine the drying out of the filaments with substantial removal of the solvents.

It has been found, however, that many kinds of technological limits are imposed on complete removal of the solvents. Thus, at too high temperatures close to the nozzles—whether through too high a solution temperature or through too high an ambient temperature—the solution spinning jets tear off just below the spinneret discharge holes, especially if the take-off speeds are high. An increase in the take-off speed is extremely desirable for economic reasons, but this measure has to date been limited by too high a pre-orientation of the threads, which inter alia manifests itself in very steep force/extension diagrams with a (too) great reduction in the breaking elongation limits.

For the reasons discussed above, however, an increase in the spinning air temperature is also limited in practice because of thermal discoloration of the threads and because of thermal instability of the spinning solvents. It has thus been found that dimethylacetamide, and also dimethylformamide, increasingly decomposes in the chimney at spinning air temperatures of more than about 300° C. to 350° C., and to a greater extent above 350° C., and decreases the yield of solvents which can be recovered. There is thus automatically an upper limit on the temperatures. If nitrogen or combustion gases ("Kemp" gas) are used as hot spinning air components instead of air, the (oxidative) degradation reaction can indeed be reduced, but the costs and expenditure rise considerably.

Another problem which is of importance industrially and to environmental technology is the persistence of too much solvent in the spun elastomer thread, in particular in the case of medium and coarse titres.

Japanese Patent Specification 44–896 (1969) described a dry spinning process for polyurethane elastomers, in which the chain has been lengthened with glycol, based on higher molecular weight polyesters, diisocyanates and ethylene glycol, dissolved in a mixture of methyl isobutyl ketone/DMF or of tetrahydrofuran as the solvent, these polyurethanes being obtained by spinning in a spinning chimney of at least 150° C. with 1 to 30 $m^3/h$ superheated steam being introduced at 150 to 400° C. above the spinneret and with moderate take-off speeds (low spinning capacity). Such threads have practically the same propertes in comparison with threads spun in the absence of steam. Highly volatile solvents, such as tetrahydrofuran, are used or co-used. Such glycol-lengthened polyurethane elastomers cannot be spun at increased chimney temperatures and simultaneously high temperatures of the gaseous spinning media; they tear off or are stretched thermoplastically, with an undesirable change in the elastic properties. The spinning capacities described according to the Japanese process are still very unsatisfactory for such glycol-lengthened polyurethanes.

The object of the invention is to provide an improved dry spinning process, according to which the polyurethane-urea (PUU) elastomers based on chain lengthening of NCO prepolymers with diamine can be spun practically entirely from highly polar solvents, such as dimethylformamide and in particular dimethylacetamide, with high spinning capacities and without the risk of decompositions of the spinning solvent at the high temperatures, to give PUU elastomer threads which now have a low content of spinning solvent and a good raw shadeandin addition have improved values in their elastic properties in comparison with threads spun from hot air. The object of the invention should be achieved here as far as possible without changing the spinning chimneys available (especially their length). With the amounts of steam quoted in the Japanese Patent Specification 44 896 cited above of 1 to 30 $m^3/h$, corresponding to about 0.5 kg/h at 150° C. to 13.6 kg/h at 150° C. of superheated steam of 150 to 400° C., no spinning was possible with the PUU elastomer solutions to be used according to the invention and with the chimney geometry present in our experiments (chimney cross-sectional area 0.0615 $m^2$—chimney diameter=28 cm). According to the invention, distinctly higher amounts of steam are required, preferably more than 50 $m^3/h$, corresponding to at least 20 kg/h, preferably more than 30 kg/h steam of 250 to 400° C. Only under this drastic increase in the amount of steam introduced of preferably 30 to 45 kg/h superheated steam of 240 to 400° C., corresponding to 30 kg/h at 250° C.=75 $m^3/h$ (at the corresponding temperature)

45 kg/h at 250° C.=112.5 $m^3/h$ 30 kg/h at 400° C.=96 $m^3/h$ 45 kg/h at 400° C.=144 $m^3/h$ can the polyurethane-ureas to be used according to the invention be spun effectively, in contrast to the amounts mentioned in the Japanese Patent Specification, of 1 to 30 $m^3$/h at 150° C. to 400° C., and not more than 0.3 to 13.6 kg/h steam.

The invention relates to an improved dry spinning process for polyurethane elastomer fibres using superheated steam as the spinning medium, characterized in that polyurethane-urea elastomers which have been prepared by chain lengthening of NCO prepolymers with diamine, are spun from their solutions in dimethylformamide or (preferably) dimethylacetamide via a hot spinneret at not less than 100° C. and at spinning solution temperatures in the nozzle of not less than 100° C., preferably 105 to 125° C., into a heated spinning chimney at a chimney wall temperature of not less than 160° C., e.g. 160 to 238° C., preferably 170 to 230° C., and in particular 175 to 225° C., and during this procedure, at chimney diameters of up to 28 cm, at least 20 kg/h, preferably 25 to 50 kg/h, particularly preferably 30 to 45 kg/h, superheated steam at above 250° C., preferably at 275 to 400° C., in particular 280 to 325° C. (measured at the height of the spinneret in the centre of the chimney under free flow), are introduced as the hot spinning medium, and at larger chimney diameters preferably steam amounts which are increased by the ratio H of the chimney cross-sections, in particular only 0.1 H to 0.8 H and especially only 0.2 to 0.6 H, are introduced as the hot spinning medium, at the end of the spinning chimney the spinning medium and spinning solvent are fed to a recovery step, and a take-off speed of the threads from the chimney of at least 250 m/min, e.g. at least 400 m/min and preferably 500 to 1,500 m/min, in particular 500 to 1,200 m/min, is observed.

In the process according to the invention, polyurethane-urea elastomer threads (PUU threads) can be spun in an outstanding profitability, spinning chimney capacity and quality. In spite of the very high spinning speeds in some cases (e.g. > 500, e.g. up to 1,500 m/min), these polyurethane-urea elastomer threads surprisingly do not show the marked decrease in extensibility and undesirable high modulus values of the threads, in contrast to the customary spinning speeds (e.g. of about 200 m/min), but surprisingly rather show an increase in the elongation at break in comparison with similar spinning conditions in hot air (if such spinning is possible at all with hot air). One of the reasons possibly lies in the interaction between the water (vapour) and the polyurea rigid segments in the PUU elastomers at the high spinning temperatures, with a simultaneously reduced salvation effect of remaining contents of residual solvent, but this is only an attempt at interpretation of the unexpected findings.

The steam spinning process according to the invention is especially advantageous on coarser titres (about > 500 dtex, preferably > 1,000 dtex) and at relatively coarser filament individual titres (from about 10 to 25 dtex of the individual filaments which are weakly adhering (coalesced) to one another in the final state of the elastomer filament yarns (see literature). Such coarse titres hitherto had to be spun at a relatively slow speed and with a reduced capacity (see comparison example), in order to achieve on the one hand adequate drying out and on the other hand a preorientation which is not too great (reduced extensibility).

In spite of the slow spinning speeds, however, undesirably high contents (e.g. 1.5 to 3 wt.% DMA) of solvents still remained in the threads of coarser titres in the dry spinning processes of the prior art and had to be decreased, if appropriate, by further after-treatment steps.

As can be seen from comparison experiments, the same PUU elastomer solutions can be spun by the process claimed according to the invention, e.g. with the particularly critical coarse titres (about 1,300 dtex), in spite of the increase in the take-off speeds to at least twice (·) the take-off speed (e.g. from about 250 to 280 m/min to 500 to 600 m/min and thus with at least twice the chimney capacity), and a similar spinning apparatus (chimney length the same, chimney diameter the same, amount of spinning hot air medium about the same, spinning solution temperature the same), without the thread characteristics being changed undesirably, if a sufficient amount of superheated steam is used instead of hot air as the hot spinning medium. Moreover, the residual content of spinning solvent dimethylacetamide is reduced from about 1.5 to 3 wt.% or more to < 1.5 wt.%, and usually even < 1.0 wt.%, although the spinning capacity has been increased considerably and although spinning has been carried out at high filament individual titres or overall titres.

It is particularly surprising here that at the high temperatures in the steam atmosphere the thermal decomposition phenomenon of the solvents, e.g. dimethylacetamide, is very substantially reduced and there is an exceptionally large reduction in the content and number of various decomposition products (to about $\frac{1}{3}$) and the amount of decomposition products (e.g. reduced by a factor of 50), although it was in fact to be expected that water (vapour) under these high temperatures should have the effect of a very noticeable hydrolysis of dimethylformamide or dimethylacetamide.

Analyses of the spinning waste air downstream of the spinning condenser in which the spinning gas and the spinning solvent vaporized in the spinning chimney are condensed led, in the case of the comparison example with spinning air of 400° C. (without steam) as the spinning gas medium and dimethylformamide as the spinning solvent, to the following amounts (in mg/1 spinning condenser mixture, i.e. in the solvent condensate) of decomposition products:

formaldehyde = 2 to 3 mg/1
formic acid = 170 to 172 mg/1
dimethylamine = 12 to 13 mg/1
plus further modification products.

In the case of superheated steam (40 kg/h at 400° C.) instead of air at the same temperature as the spinning gas medium, the following amounts of decomposition products are determined by analysis:

formaldehyde = < 2 mg/1
formic acid = 9 to 17 mg/1
dimethylamine = < 1 mg/1
practically no further modification products.

As can be seen from the comparative measurements, the number of decomposition products is reduced in the case of spinning with superheated steam by a factor of at least 10 in comparison with air spinning. This is of considerable ecological importance.

As already stated, the process according to the invention is of particular advantage for medium and coarse titres (about 250 to 560 dtex; or > 560 dtex, in particular > 800 dtex) and especially for thicker individual filaments, e.g. ≧ 8 dtex, since threads with a low residual content of solvent are also obtained under these more difficult conditions.

Nevertheless, the process according to the invention is also of great advantage for fine titre elastomer threads, in which case it has proved to be essential to spin such fine titres at relatively high temperatures—without the risk of decomposition of the solvents dimethylformamide and in particular dimethylacetamide—and in this way to achieve economic production capacities and a considerably increased spinning speed. This is particularly the case with spinning processes where 4, 8, 16 or even 24 groups of threads (for example each consisting of 3 to 6 individual filaments) are spun from a single dry spinning chimney. In addition to the great economic effect of the spinning capacity, however, product-saving and ecologically better spinning conditions can also be realized in the new process.

Possible polyurethane-urea elastomer threads are all the PUU elastomers in which the chains are lengthened with diamine and which are built up in segmented form (see the literature cited above. They are prepared from NCO prepolymers with about 1.5 to 4 wt.% NCO end groups and diamines as chain lengtheners. As diamines in the narrower sense there are used here aliphatic, cycloaliphatic or araliphatic diamines or their mixtures, e.g. ethylenediamine, 1,2-propylenediamine, trimethylenediamine, $H_2N.CH_2.C(CH_3)_2.CH_2.NH_2$,1,3-diaminocyclohexane, isophoronediamine, m-xylylenediamine and many other diamines, but preferably ethylenediamine as the main component, if appropriate mixed with about 30 mol% 1,2-propylenediamine, 1,3-diaminocyclohexane, piperazine and others. Monoamines can also be used in small amounts as chain stoppers/chain regulators. Diamines in the broader sense also include hydrazine, as well as dihydrazide compounds, e.g. carbodihydrazide, hydrazide semicarbazides, semicarbazidecarbazine esters and similar compounds.

The NCO prepolymers are prepared from higher molecular weight diols, e.g. polyesters (including polylactones), polyethers, preferably polyoxytetramethylenediols, polyether-esters etc. of molecular weight about 1,000 to 4,000, by reaction with excess amounts (e.g. 1.5 to 2.5 mol) of diisocyanates, such as e.g. diphenylmethane 4,4'-diisocyanate (MDI), toluylene diisocyanate or cyclohexane 1,3-diisocyanate, in the melt or preferably in solvents. NCO prepolymers with about 1.5 to 2.9% NCO or 1.6 to 2.5% NCO and MDI as the diisocyanate are preferred.

If appropriate, further components can also be used in the NCO prepolymer formation, e.g. N-methyldiethanolamine or N-methyl-bis-(a-hydroxypropyl)amine.

The NCO prepolymers (or their solutions) can be reacted continuously or discontinuously with the diamine compounds in highly polar solvents, such as dimethylformamide or dimethylacetamide, the $NCO/NH_2$ equivalent ratios being between about 0.9 and 1.1.

Starting substances and processes are known from a large number of publications and patents on elastomer threads and can be used to prepare the polyurethane-urea elastomer solution in the context of the process. The polyurethane-urea elastomer spinning solutions in general have viscosities of about 50 to 250, preferably 70 to 180 Pas at room temperature. The concentrations are in general between 20 and 35 wt.%, preferably 22 and 30 wt.%.

The spinning solutions can contain the customary additives and stabilizers, e.g. white pigments, such as titanium dioxide (rutile or anatase), zinc oxides of any desired purity, zinc sulphide, coloured pigments or dyestuffs, stabilizers and anti-ageing agents, UV stabilizers, anti-adhesion agents, such as magnesium stearate and/or zinc stearate (e.g. 0.1 to 0.8 wt.%—or any desired mixtures thereof), zinc oxides, if appropriate containing up to 4% other oxides, such as magnesium oxide, or magnesium carbonate, agents for improving flow, such as silicone oils (polydimethylsiloxanes) or soluble polyoxyalkylene/dimethylsiloxane copolymers. Here also, suitable substances are named in many instances in the literature.

The elastomer solutions are filtered and passed to the individual spinning chimneys. Before being introduced into the spinnerets, the solutions must be preheated to the extent that they are heated to at least 100° C. within the spinnerets. Although temperatures of 90 to 95° C. during feeding in of the solution are already sufficient and the residual supply of heat is effective via that in the high temperature region (spinning air/steam/ chimney heating) to keep the solution temperature and nozzle surface temperature at above 100° C. to just below the boiling point of the solvents dimethylformamide/dimethylacetamide, preferably 105 to 135°, it is more reliable for the process if the solution temperature is set at $\geqq 100°$ C. when this is fed in. This can be done e.g. via short preheating zones and circulation via static mixer elements. The nozzles to be employed are likewise mounted in the preheated state at $\geqq 100°$ C., in order to prevent condensation of steam during spinning.

The customary heated chimneys with a length of 5 to 15 m, preferably 7 to 12 m, and diameters of 25 to 70, preferably 27 to 55 cm, are used as the spinning chimneys. The spinning chimneys can be heated over the entire length or over part lengths, if appropriate at different temperatures.

The steam is fed in from a steam heater located at a certain distance from the spinning chimneys. In general somewhat higher temperatures are generated in the steam there, in order to show the stated temperatures at the spinning chimney—depending on the insulation/distance etc. The amounts are determined via e.g. perforated diaphragms. The temperatures of the steam are determined at about the level of the spinnerets. The amount of steam introduced into the spinning chimney depends on the cross-section of the spinning chimney and to a certain minor degree on the amount of spinning solution introduced (the amount of spinning solvent in the chimney). In a chimney of 615 $cm^2$ cross-section ($d=28$ cm) e.g. an amount of 50 $m^3/h$ superheated steam results in a flow rate of 812 m/h (0.225 m/sec). On transition to other chimney cross-sections, the amount of steam is to be adjusted, if appropriate, according to the ratio (H) of the chimney cross-sections, if this appears to be necessary. The ratio H here represents the quotient of the enlarged chimney cross-section to the chimney cross-section of 615 $cm^2$ (28 cm chimney diameter). Preferably, the amount of steam is increased by only a proportion of this ratio H, e.g. 0.1 H to 0.8 H (i.e. only 10% to 80% increase over the amount of steam for a "normal" spinning chimney diameter of 28 cm). In particular, the increase in the amount of steam is only 0.2 H to 0.6 H. The smaller value of x.H is chosen in particular for the larger chimney diameters.

For economic reasons, the amount of steam here is set at the lowest value necessary for the process. With a simultaneous increase in the elastomer solution throughput (chimney capacity) and the chimney cross-section, there will be a tendency to use more steam than with merely an enlargement in the chimney cross-section.

Preparation of a polyurethane-urea elastomer spinning solution

A polyester with terminal hydroxyl groups and an average molecular weight of 2,000 (OH number of 56) was prepared in the customary manner by reaction of 10 kg adipic acid with 8.1 kg hexane-1,6-diol and 7.1 kg 2,2-dimethyl-propane-1,3-diol (neopentylglycols 10 kg of this polyester were heated at 50 to 54° C. together with 190 g N,N-bis-hydroxypropyl)methylamine, 2,600 g diphenylmethane 4,4'-diisocyanate (containing 0.6% diphenylmethane 2,4-disisocyanate) and 3.2 kg dimethylacetamide for 100 min, while stirring, until the NCO content of the prepolymer was 2.66 wt.% (based on the solids 245 g ethylenediamine were dissolved in 43.45 kg dimethylacetamide, the solution was initially introduced into a kettle and 270 g solid $CO_2$ was added, so that a carbamate suspension was formed. 16 kg prepolymer solution (prepared as above) were added to this freshly formed suspension, while stirring intensively. A homogeneous, clear elastomer solution with a solids content of 22 wt.% and a solution viscosity of 92.6 Pas was obtained. 4 wt.% titanium dioxide, 0.3 wt.% magnesium stearate and 1% silicone oil Baysilon® M100 (Bayer AG), based on the PU solid, were added to the viscous polymer solution. 1% Cyanox® 1790 (stabilizer of the formula 2,4,6-tris-(2,4,6-trimethyl-3-hydroxybenzyl) isocyanurate) was also added to the solution.

COMPARISON EXAMPLE

A 22 wt.% polyurethane-urea elastomer solution in dimethylacetamide (see preparation instructions) was spun on an 8.8 m long spinning chimney with an internal diameter of 28 cm from a 96-hole nozzle of 0.3 mm hole diameter to give elastomer threads with a fineness of 1,200 dtex. The threads were taken off underneath the spinning chimney on a first godet at 375 m/min, taken over by a second godet at 390 m/min and wound onto spools at a wind-up speed of 450 m/min. The spinning chimney (wall heating) temperature was 200° C. Spinning was carried out with 56 $Nm^3/h$ hot air of 380° C. The solution lines and spinning head were preheated at 110° C.

The following fibre technology values were determined on the spun elastomer filament yarns:

| | | |
|---|---|---|
| Thread fineness | 1163 dtex | |
| Maximum tractive force | 930 cN | (measurement instructions see Ex. 1) |
| Maximum tractive force elongation | 429% | |
| Tensile force of the thread when drawn 1:4 in rolling take-off | 213 cN | |
| Residual content of solvent dimethylacetamide | 3.1% | |
| Spinning chimney capacity | 3.2 kg | elastomer yarn/h |

In another part of the experiment, an attempt was made to drive off all the spinning solvent by increasing the chimney temperature from 200 to 220° C., and in further parts of the experiment by further increasing the temperature from 380° C. to 400° C. (measured at the outlet of the air heater). In all cases the threads tore off after the increases in temperature and showed the start of yellowing. The limit of the thermal exposure of the threads had evidently been exceeded.

EXAMPLE 1

The 22 wt.% PUU elastomer solution in dimethylacetamide described above was spun to threads on an 8.8 m long spinning chimney of cross-section 28 cm from a 96-hole nozzle with a hole diameter of 0.3 mm. During this procedure, 300 $cm^3$ spinning solution (about 100° C.) per minute were forced through the nozzle. The speed of godet 1) was 415 m/min and that of godet 2) 435 m/min, and the wind-up speed was 500 m/min. The spinning chimney temperature (chimney heating) was 200° C. Spinning was carried out with 40 kg/h superheated steam of 400° C. (measured at the steam heater/310 to 320° C. steam temperature close to the nozzle). The solution lines and spinning head were preheated at 110° C.

The following fibre technology values were determined on the spun elastomer filament yarns:

| | | |
|---|---|---|
| Thread fineness | 1323 dtex | |
| Maximum tractive force (in accordance with DIN 53 835, part 2) - simple traction test) | 1397 cN | |
| Maximum tractive force elongation (in accordance with DIN 53 835, part 2) - simple traction test) | 487% | |
| Tensile force of the thread when drawn 1:4 in rolling take-off | 185 cN | |
| Residual content of solvent dimethylacetamide | 0.85% | |
| Spinning chimney capacity | 4.0 kg | elastomer filament yarn/h |

EXAMPLE 2

The 22 wt.% solution, as described was spun on the chimney mentioned and with similar nozzles. During this procedure, 325 $cm^3$ spinning solution of about 110° C. per minute were forced through the nozzle. The speed of godet was again 415 m/min and that of godet 2) 435 m/min. The wind-up speed, however, was increased to 550 m/min. All the other spinning data were retained unchanged in accordance with example 1.

The following fibre technology values were measured on the spun elastomer filament yarns:

| | | |
|---|---|---|
| Thread fineness | 1308 dtex | |
| Maximum tractive force | 1216 cN | |
| Maximum tractive force elongation | 437% | |
| Tensile force of the thread when drawn 1:4 in rolling take-off | 262 cN | |
| Residual content of solvent dimethylacetamide | 0.86% | |
| Spinning chimney capacity | 4.31 kg | elastomer filament yarn/h |

As can be seen from the examples, higher spinning speeds coupled with distinctly lower contents of residual solvents in the elastomer threads and with improved fibre technology data can be achieved with the spinning medium of superheated steam instead of air. Distinctly higher spinning chimney capacities can thus be realized with the process described here. An increase in the maximum tractive force of the elastomer threads by 30 to 50% over the comparison example is obtained. The cause is not known, but must be based on the changed mechanisms of the solvent removal. The significantly better removal of residual solvent from the elastomer filament threads in spite of shorter residence times in the spinning chimney is of great practical/technological importance. In addition to the economic advantages, distinct ecological progress in respect of the nature and amount of decomposition products in the spinning waste air is also achieved, as already mentioned.

EXAMPLE 3

As in examples 1 and 2, the PUU elastomer solution mentioned, in dimethylacetamide, was spun with 353 $cm^3$ spinning solution of 110° C. per minute. The speed of godet 1) was 410 m/min and that of godet 2) 545 m/min, and the wind-up speed was increased to 600 m/min. Spinning was carried out with 45 kg/h steam of 400° C. (at the steam heater/corresponding to 320o close to the nozzle). The chimney temperature was 225° C. The following fibre technology values were determined on the elastomer filament yarns spun in this way:

| | | |
|---|---|---|
| Thread fineness | 1217 dtex | |
| Maximum tractive force | 1208 cN | |
| Maximum tractive force elongation | 400% | |
| Tensile force of the thread when drawn 1:4 in rolling take-off | 401 cN | |
| Residual content of dimethylacetamide | 0.95% | |
| Spinning chimney capacity | 4.3 kg | elastomer filament yarn/h |

In a modification of the experiment, the speed of godet 1) was increased to 585 m/min and that of godet 2) to 610 m/min, and the wind-up speed was increased to 700 m/min and the throughput of elastomer solution to 414 $cm^3$/min. The other spinning parameters were retained unchanged. Threads of 916 dtex fineness were obtained. The fibre technology properties largely corresponded to the values from example 3/first part of the experiment, and the residual content of spinning solvent in the threads was only 0.96 wt.%, in spite of the increased spinning capacity.

We claim:

1. An improved dry spinning process for the production of polyurethane elastomer threads using superheated steam as the spinning medium, comprising (1) spinning polyurethane-urea elastomers, prepared by chain lengthening of NCO pre-polymers with diamine from a solution containing dimethylformamide or dimethylacetamide, via a hot spinneret having a nozzle at a spinning solution temperature in the nozzle of not less than 100° C. into a heated spinning chimney having a chimney wall temperature of not less than 160° C., while (2) introducing superheated steam into the spinning chimney at a temperature above 250° C. as the spinning medium in an amount of at least 20 kg/h, if the chimney diameter is less than or equal to 28 cm, or if the chimney diameter is greater than 28 cm, in an amount of at least 20 kg/h increased by up to a factor H, wherein factor H is equal to the chimney cross-section/615 $cm^2$, (3) feeding the spinning medium and spinning solvent to a recovery step at the end of the spinning chimney, and (4) maintaining a take-off speed of the threads from technique of at least 250 m/min.

2. The process according to claim 1, wherein polyurethane-urea elastomers prepared by chain lengthening of NCO prepolymers with diamine are spun from a solution containing dimethylacetamide.

3. The process according to claim 1, wherein the spinning solution temperatures in the spinneret nozzle are 105 to 125° C.

4. The process according to claim 1, wherein the chimney wall temperature is 160 to 238° C.

5. The process according to claim 1, wherein the superheated stem is introduced into the spinning chimney at a temperature 275°–400° C. as the spinning medium in an amount of at least 25–50 kg/h, if the chimney diameter is less than or equal to 28 cm, or if the chimney diameter is greater than 28 cm, in an amount of at least 25–50 kg/h increased by a factor 0.1 H to 0.8 H.

6. The process according to claim 5, wherein the superheated stem is introduced into the spinning chimney at a temperature 280°–325° C. as the spinning medium in an amount of at least 30–45 kg/h, if the chimney diameter is less than or equal to 28 cm, or if the chimney diameter is greater than 28 cm, in an amount of at least 30–45 kg/h increased by a factor 0.2 H to 0.6 H.

* * * * *

UNITED STATES PATENT AND TRADEMARK OFFICE

CERTIFICATE OF CORRECTION

PATENT NO. : 5,057,260

DATED : October 15, 1991

INVENTOR(S) : Reinehr et al.

It is certified that error appears in the above-identified patent and that said Letters Patent is hereby corrected as shown below:

Col. 10, line 24 Delete " technique " and substitute -- the chimney --

Signed and Sealed this

Twenty-first Day of September, 1993

Bruce Lehman

*Attest:*

BRUCE LEHMAN

*Attesting Officer*

*Commissioner of Patents and Trademarks*